US012196514B2

(12) United States Patent
Lewin et al.

(10) Patent No.: US 12,196,514 B2
(45) Date of Patent: Jan. 14, 2025

(54) BLAST ATTENUATION DEVICE

(71) Applicant: BAE SYSTEMS plc, London (GB)

(72) Inventors: Richard Peter Lewin, Cumbria (GB); Peter Andrew Griffith, Cumbria (GB)

(73) Assignee: BAE SYSTEMS PLC, London (GB)

( * ) Notice: Subject to any disclaimer, the term of this patent is extended or adjusted under 35 U.S.C. 154(b) by 0 days.

(21) Appl. No.: 18/261,005

(22) PCT Filed: Jan. 7, 2022

(86) PCT No.: PCT/GB2022/050023
§ 371 (c)(1),
(2) Date: Jul. 11, 2023

(87) PCT Pub. No.: WO2022/153035
PCT Pub. Date: Jul. 21, 2022

(65) Prior Publication Data

US 2024/0093958 A1 Mar. 21, 2024

(30) Foreign Application Priority Data

Jan. 12, 2021 (GB) ..... 2100374

(51) Int. Cl.
*F41A 21/36* (2006.01)

(52) U.S. Cl.
CPC ..... *F41A 21/36* (2013.01)

(58) Field of Classification Search
CPC ..... F41A 21/36; F41A 21/30; F41A 21/32; F41A 21/34; F41A 21/325; F41A 21/38; F41A 21/40
See application file for complete search history.

(56) References Cited

U.S. PATENT DOCUMENTS 118,933 A * 9/1871 Hawley ..... F41A 21/36 89/14.3
1,333,402 A * 3/1920 Galliot ..... F41A 21/36 89/14.3
1,413,903 A * 4/1922 Czegka ..... F41A 13/10 89/14.1

(Continued)

FOREIGN PATENT DOCUMENTS

CN 105423808 A 3/2016
GB 131040 A 8/1919
WO 2022153035 A1 7/2022

OTHER PUBLICATIONS

International Search Report and Written Opinion received for PCT/GB2022/050023, mailed Apr. 21, 2022. 14 pages.

(Continued)

*Primary Examiner* — Joshua E Freeman
(74) *Attorney, Agent, or Firm* — Finch & Maloney PLLC

(57) ABSTRACT

A blast attenuation device (100, 1100) for a gun tube (10). The blast attenuation device (100, 1100) has a first wall section (102, 1102) which defines a first chamber (104, 1104), which extends from an inlet end (106, 1106) having an inlet aperture (108, 1108) to an outlet end (110, 1100) having an outlet aperture (112, 1112). The blast attenuation device (100, 1100) also has a second wall section (122, 1122) which defines a second chamber (124, 1124), which extends from an inlet end (126, 1126) having an inlet aperture (128, 1128) to an outlet end (130, 1130) having an outlet aperture (132, 1132).

19 Claims, 11 Drawing Sheets

(56) References Cited

U.S. PATENT DOCUMENTS

| | | | | | |
|---|---|---|---|---|---|
| 2,101,850 | A | | 12/1937 | Green | |
| 2,150,161 | A | * | 3/1939 | Green | F41A 21/34 89/14.3 |
| 2,363,563 | A | * | 11/1944 | Vinson | F41A 13/12 89/14.1 |
| 2,625,235 | A | * | 1/1953 | Caulkins | F16L 55/04 137/848 |
| 2,667,815 | A | * | 2/1954 | Strong | F41A 21/36 89/14.3 |
| 2,668,479 | A | * | 2/1954 | Batten | F41A 21/40 89/14.3 |
| 3,368,453 | A | * | 2/1968 | Shaw | F41A 21/36 89/14.3 |
| 3,409,232 | A | * | 11/1968 | Cholin | A62C 13/006 89/14.3 |
| 4,307,652 | A | * | 12/1981 | Witt | F41A 21/36 89/14.3 |
| 4,583,445 | A | * | 4/1986 | Blair | F41A 21/34 89/14.3 |
| 8,286,750 | B1 | * | 10/2012 | Oliver | F41A 21/30 89/14.4 |
| 9,080,829 | B1 | * | 7/2015 | Cellini | F41A 21/34 |
| 9,134,084 | B1 | * | 9/2015 | Harrison | F41A 21/36 |
| 9,441,901 | B1 | * | 9/2016 | Harrison | F41A 21/36 |
| 10,508,878 | B1 | * | 12/2019 | Oglesby | F41A 21/36 |
| 10,598,458 | B1 | * | 3/2020 | Cler | F41A 21/30 |
| 11,709,030 | B2 | * | 7/2023 | Baker | F41A 21/22 42/76.01 |
| 11,768,050 | B2 | * | 9/2023 | Lewin | F41A 21/36 89/14.3 |
| 2015/0292829 | A1 | | 10/2015 | Pietila | |
| 2021/0172694 | A1 | * | 6/2021 | Reel | F41A 21/34 |
| 2021/0293503 | A1 | * | 9/2021 | Fromholtz | F41A 21/38 |
| 2021/0310761 | A1 | * | 10/2021 | Søgaard | F41A 21/30 |
| 2021/0404760 | A1 | * | 12/2021 | Hipp | F41A 21/36 |
| 2022/0034620 | A1 | * | 2/2022 | Parker | F41A 21/34 |

OTHER PUBLICATIONS

GB Search Search Report under Section 17(5) received for GB application No. 2100374.4, dated May 17, 2021. 3 pages.

* cited by examiner

BLAST ATTENUATION DEVICE

The present disclosure relates to a blast attenuation device.

The present disclosure relates to a blast attenuation device for a gun tube.

BACKGROUND

A blast attenuation device is a device fitted to the muzzle of a gun, for example cannon systems including artillery and large calibre tubed/barrelled guns as well as small calibre weapons. Blast attenuation devices reduce acoustic intensity generated during firing of a projectile. They may also reduce recoil of the weapon.

Reduction of concussion is desirable in tubed gun systems to protect the senses and health of the users, and anyone else in close proximity. Most propellent driven gun systems generate enough blast overpressure to cause damage to unprotected hearing. Some larger calibre gun systems generate enough blast overpressure to cause organ damage.

A blast attenuation device may define a hollow bore, through which a projectile will travel along and exit, as well as internal sound baffles. In use, most of the expanding gas propelling the projectile is redirected through a longer and convoluted escape path created by the baffles. This dissipates the kinetic energy of the gas thus lowering the operational acoustic intensity.

The construction of traditional blast attenuation devices results in a muzzle device which is relatively large and heavy when compared to the size of the barrel on which it is to be used. In small arms this results in a heavy device but one which finds practical applications. For larger calibre systems a traditional blast attenuation device becomes impractically large, and thus is impossible to use in service.

A further downside of the current state of the art blast attenuation devices is that the many baffle plates of which they are made require regular cleaning and maintenance to ensure continued optimum performance of the blast attenuation device.

Hence a blast attenuation device which reduces blast over pressure experienced by a user of the weapon, is of a straightforward and compact construction, is highly desirable.

SUMMARY

According to the present disclosure there is provided an apparatus as set forth in the appended claims. Other features of the invention will be apparent from the dependent claims, and the description which follows.

Accordingly there may be provided a blast attenuation device (100, 1100) for a gun tube (10). The blast attenuation device (100, 1100) may have a longitudinal axis (20) and comprise a first wall section (102, 1102) which defines a first chamber (104, 1104), which extends from an inlet end (106, 1106) having an inlet aperture (108, 1108) to an outlet end (110, 1100) having an outlet aperture (112, 1112). It may further comprise a second wall section (122, 1122) which defines a second chamber (124, 1124), which extends from an inlet end (126, 1126) having an inlet aperture (128, 1128) to an outlet end (130, 1130) having an outlet aperture (132, 1132). The second wall section (122, 1122) may be spaced apart from the first wall section (102, 1102) to define a flow passage (142, 1142) between the first wall section (102, 1102) and second wall section (122, 1122). The configuration is such that gas flow through the flow passage (142, 1142) forms an outer gas flow region; gas flow through the second wall section outlet aperture (132, 1132) forms a central gas flow region; and the outer gas flow region bounds the central gas flow region.

The first wall section (102, 1102) and second wall section (122, 1122) may define a first region (144, 1144) of a bore (140, 1140) of the blast attenuation device (100, 1100), the first wall section (102, 1102) and the second wall section (122, 1122) being coaxial with the longitudinal axis (20).

The second wall section (122, 1122) may be located in the outlet aperture (112, 1112) of the first wall section (102, 1102), such that the first wall section (102, 1102) inlet aperture (108, 1108), second wall section (122, 1122) inlet aperture (128, 1128), first wall section (102, 1102) outlet aperture (112, 1112) and second wall section (122, 1122) outlet aperture (132, 1132) are provided in series along the longitudinal axis (20).

The blast attenuation device (100, 1100) may further comprise a support hub (150) which defines an inlet end (156) having an inlet aperture (158) to an outlet end (160) having an outlet aperture (162); wherein the hub outlet end (160) extends to/from the inlet end (106) of the first wall section (102); the support hub (150) being coaxial with the longitudinal axis (20). The support hub may define a second region (146) of the bore (140) of the blast attenuation device (100, 1100).

The first wall section (102) may have a constant internal diameter along its length between its inlet end (106) and outlet end (110); and the second wall section (122) may have a constant internal diameter along its length between its inlet end (126) and outlet end (130).

The first wall section (1102) may increase in internal diameter from the inlet aperture (1108) of the first chamber (1104) to a maximum diameter (Dmax) to define a divergent region (1170) of the first chamber (1104); and may decrease in diameter from the maximum diameter (Dmax) to the outlet aperture (1112) to define a convergent region (1171) of the first chamber (1104).

The second wall section (1122) may decrease in internal diameter from the inlet aperture (1128) of the second chamber (1124) to a minimum diameter (Dmin) to define a compression cone (1180); and then extend with a constant diameter of Dmin to the outlet aperture (1132) to define a flow passage (1182).

The convergent region (1171) of the first chamber (1104) may be divided into sub-regions (1172, 1174, 1176, 1178) which extend in series from the maximum diameter (Dmax) to the outlet aperture (1112). At least one of the sub-regions (1176) may have a constant internal diameter along its length, and is spaced apart from the outlet aperture (1112) of the first wall section (1102) by a sub-region which decreases in diameter towards the outlet aperture (1112) of the first wall section (1102); and may be spaced apart from the diameter of maximum diameter (Dmax) of the first wall section (1102) by a sub-region which decreases in diameter towards the sub-region (1176) of constant internal diameter.

The convergent region (1171) of the first chamber (1104) may comprise a first sub-region (1172), a second sub-region (1176) and a third sub-region (1178) provided in series. The first sub-region (1172) may extend from the diameter of maximum diameter (Dmax) towards the second sub-region (1176), and the third sub-region (1178) may extend from the second sub-region (1176) towards the outlet aperture (1112) of the first wall section (1102). The second sub-region (1176) may have a constant internal diameter along its length, and may be spaced apart from the outlet aperture (1112) of the first wall section (1102) by the third sub-region (1178) which decreases in diameter towards the outlet aperture (1112) of the first wall section (1102). The second sub-region (1176) may be spaced apart from the divergent region (1170) of the first wall section (1102) by the first sub-region (1172) which decreases in diameter towards the second sub-region (1176).

The convergent region (1171) of the first chamber (1104) may further comprise a fourth sub-region (1174) which extends between the first sub-region (1172) and the second sub-region (1176); wherein the fourth sub-region (1174) decreases in diameter from first sub-region (1172) to the second sub-region (1176).

The first wall section (1102) in the divergent region (1170) may extend at an angle A1 of at least 5 degrees but no more than 60 degrees to the longitudinal axis (20).

The first wall section (1102) in the first sub-region (1172) of the convergent region (1171) may extend at an angle A2 of at least 10 degrees but no more than 65 degrees to the first wall section (1102) in the divergent region (1170).

The first wall section (1102) in the fourth sub-region (1174) of the convergent region (1171) may extend at an angle A3 of no more than 30 degrees to the first wall section (1102) in the first sub-region (1172).

The first wall section (1102) in the third sub-region (1178) of the convergent region (1171) may extend at an angle A4 of at least 15 degrees but no more than 90 degrees to the first wall section (1102) in the second sub-region (1176).

The second wall section (1122) may define a first radially outer surface (1183) which faces the second sub-region (1176) of the first wall section (1102); and a second radially outer surface (1186) which extends from the first radially outer surface (1183) to the outlet end (1130) to define the outlet aperture (1132) of the second wall section (1122).

The first radially outer surface (1183) of the second wall section (1122) may be parallel to the second sub-region (1176) of the first wall section (1102) such that the flow passage (1142) therebetween has a constant flow area.

The first radially outer surface (1183) of the second wall section (1122) may be angled to the second sub-region (1176) of the first wall section (1102) such that the flow passage (1142) therebetween converges towards the outlet aperture (1112) of the first wall section (1102).

In a direction along the longitudinal axis (20), the junction between the first radially outer surface (1183) of the second wall section (1122) and the second radially outer surface (1186) of the second wall section (1122) may be within the second sub-region (1176), and spaced apart from the third sub-region (1178).

The second radially outer surface (1186) may be concave.

The second radially outer surface (1186) may be angled to the longitudinal axis (20) by the same amount as the third sub-region (1178) is angled to longitudinal axis (20).

The flow area of the flow passage (142, 1142) may be greater than the flow area of the outlet aperture (132, 1132) of the second wall section (1122).

Hence there may be provided a blast attenuation device configuration which achieves a low blast overpressure at the position of the user by generating gas flows that extend forwards towards the exit from the muzzle, while also being of a compact and low maintenance design.

BRIEF DESCRIPTION OF THE DRAWINGS

Examples of the present disclosure will now be described with reference to the accompanying drawings, in which.

DETAILED DESCRIPTION

Figure 1:
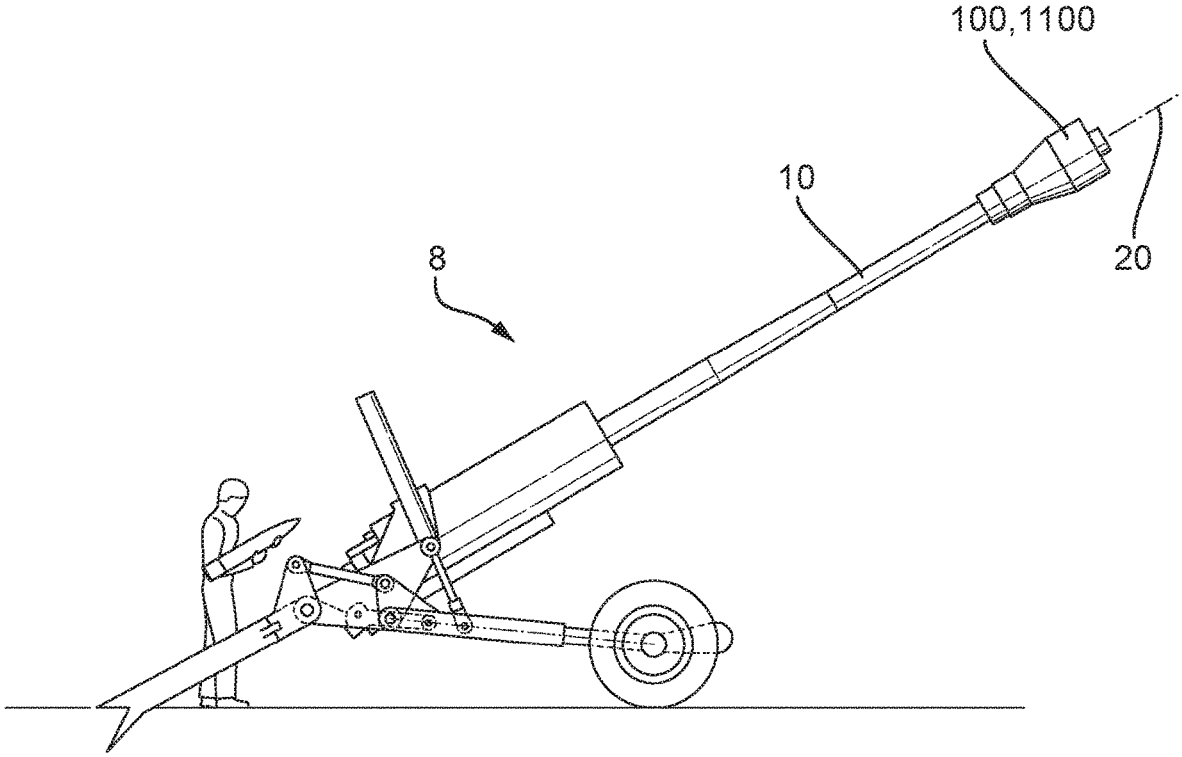
FIG. 1 shows an assembly of a gun tube and blast attenuation device of the present disclosure.
Figure 2:
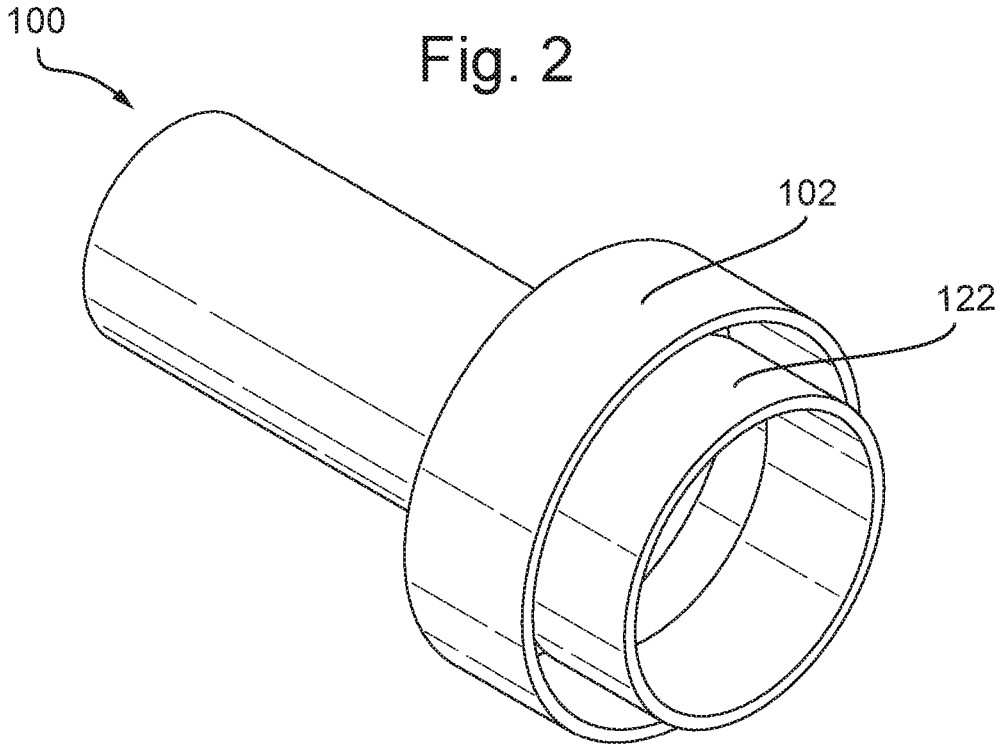
FIG. 2 is an isometric view of a first example of a blast attenuation device of the present disclosure.
Figure 3:
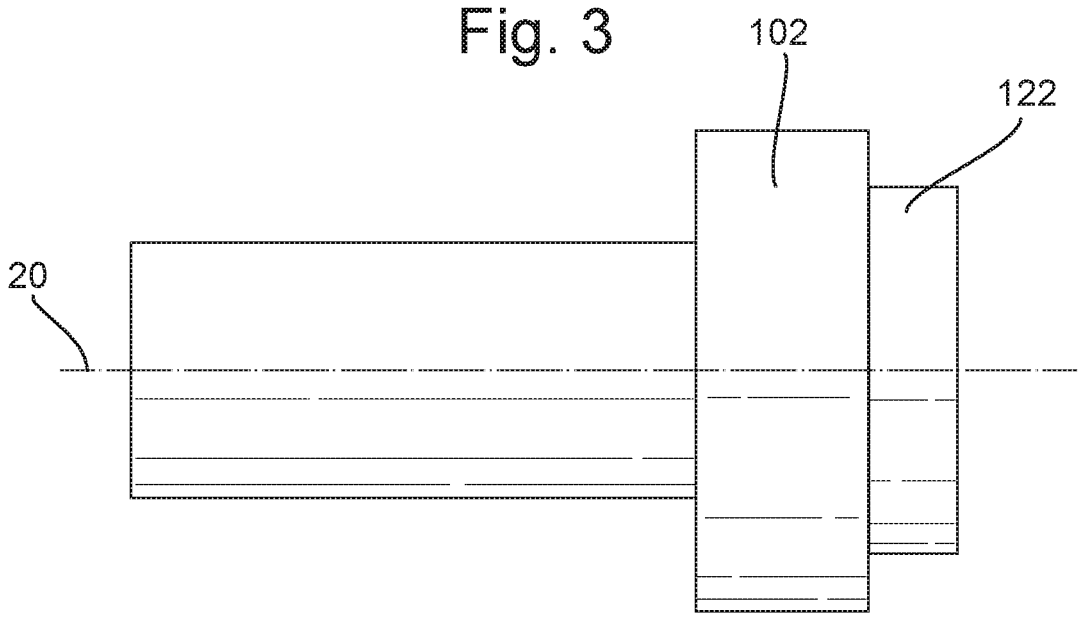
FIG. 3 is a side view of the first example of a blast attenuation device of the present disclosure.
Figure 4:
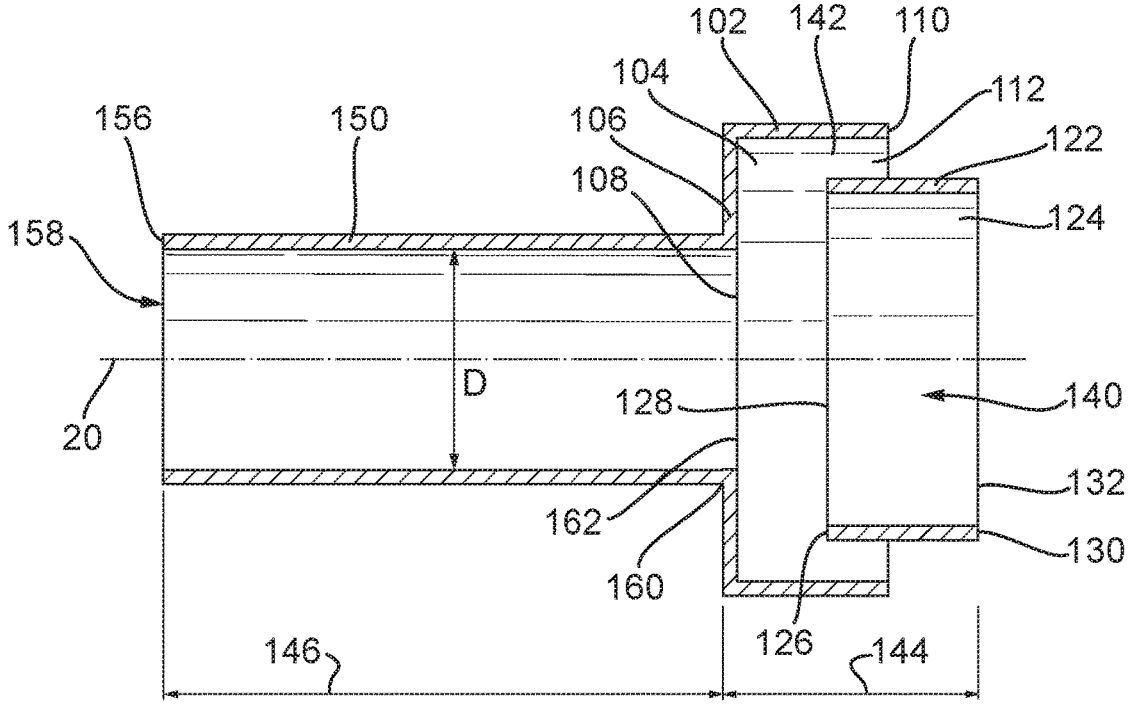
FIG. 4 is a sectional side view of the first example of a blast attenuation device of the present disclosure.

By way of non limiting example, FIG. 1 shows an example of a weapon 8 to which a blast attenuation device 100, 1100 of the present disclosure may be applied. The blast attenuation device 100, 1100 is provided at the exit from a gun tube (i.e. a barrel) 10, as is well known and understood in the art. That is to say, the blast attenuation device 100, 1100 is configured for use on a gun tube 10 (i.e. a barrel).

Figure 16:
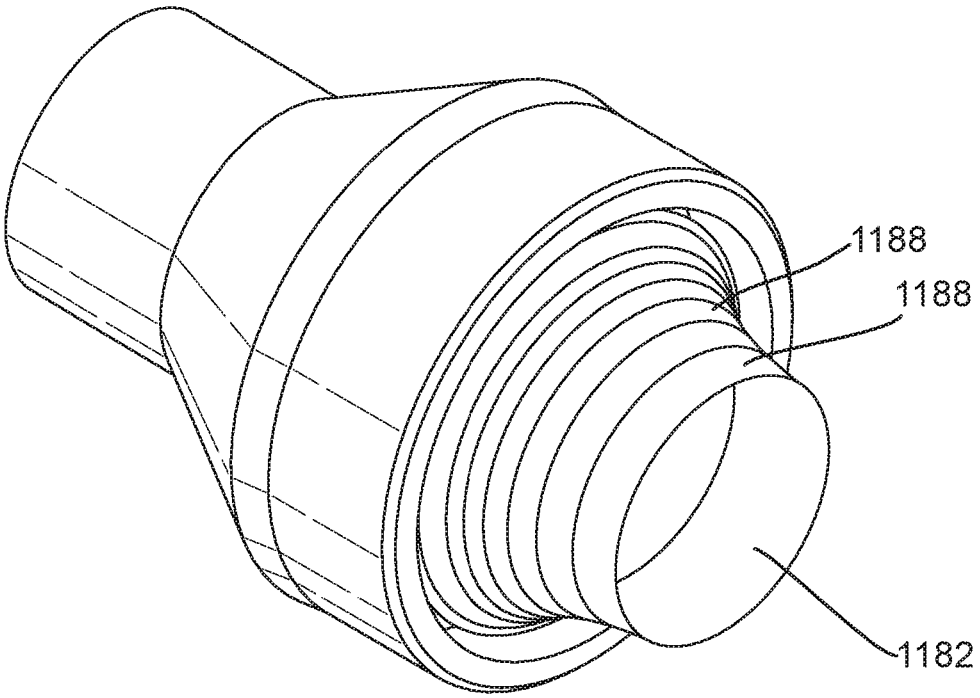
FIG. 16 is an isometric view of a third example of a blast attenuation device of the present disclosure.
Figure 17:
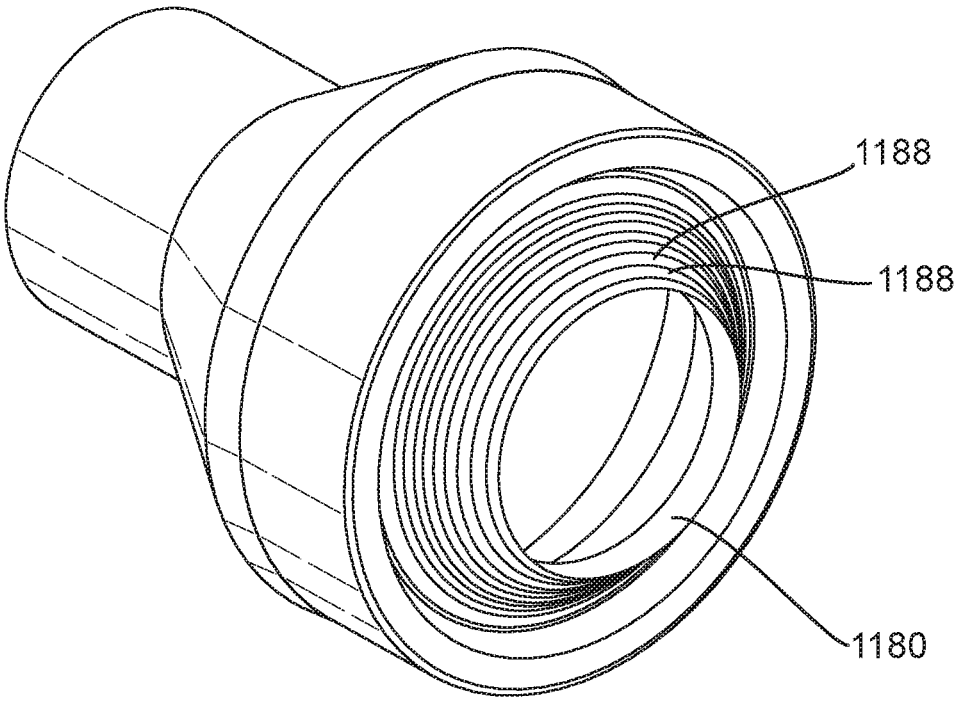
FIG. 17 is an isometric view of a fourth example of a blast attenuation device of the present disclosure.
Figure 18:
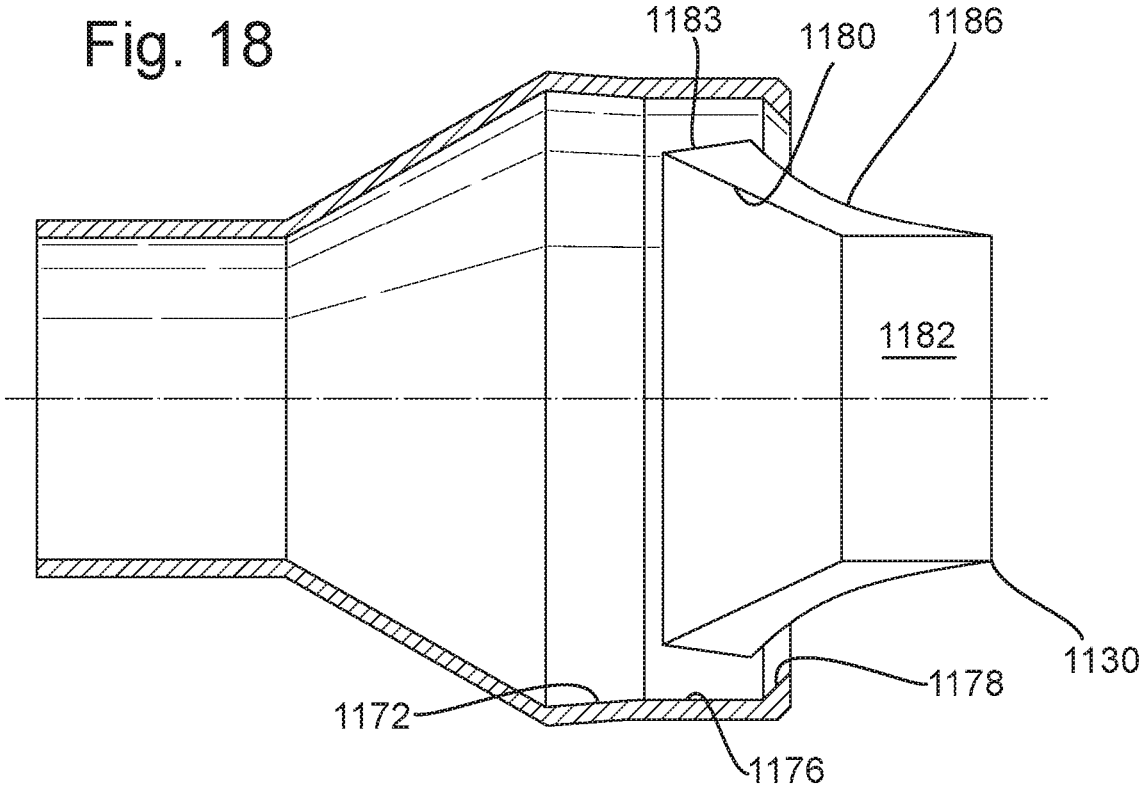
FIG. 18 is a sectional side view of the third example of a blast attenuation device of the present disclosure.
Figure 19:
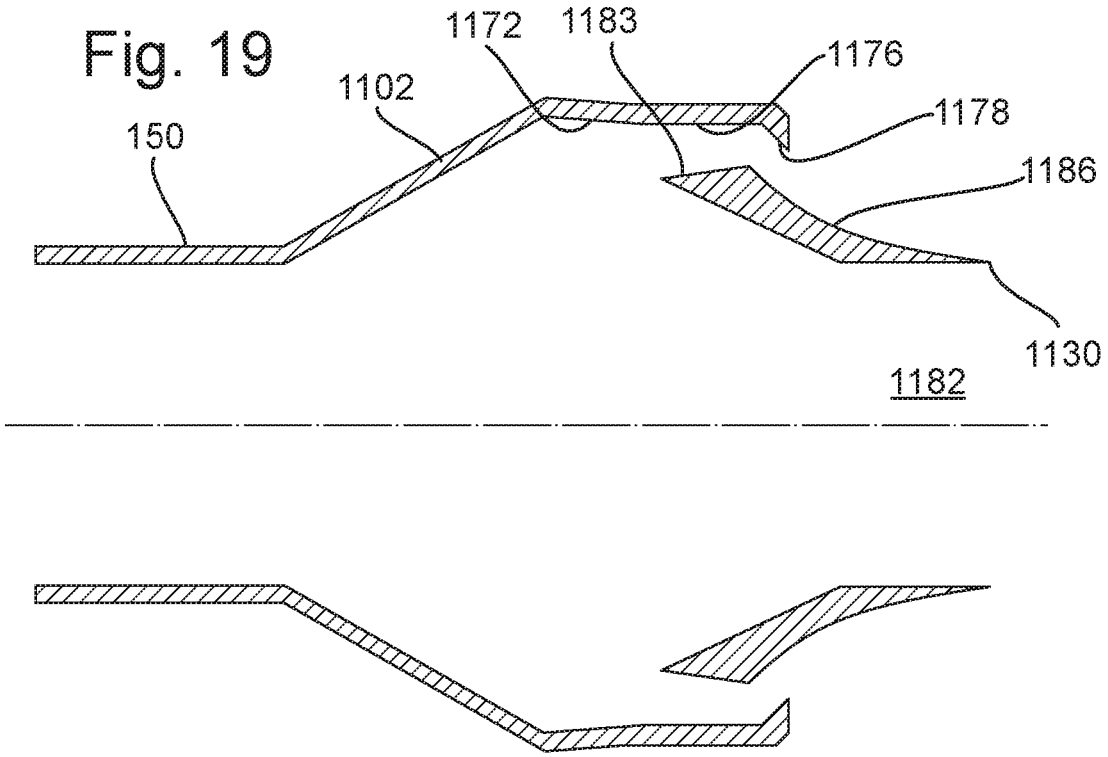
FIG. 19 is an alternative sectional side view to that shown in FIG. 18.
Figure 20:
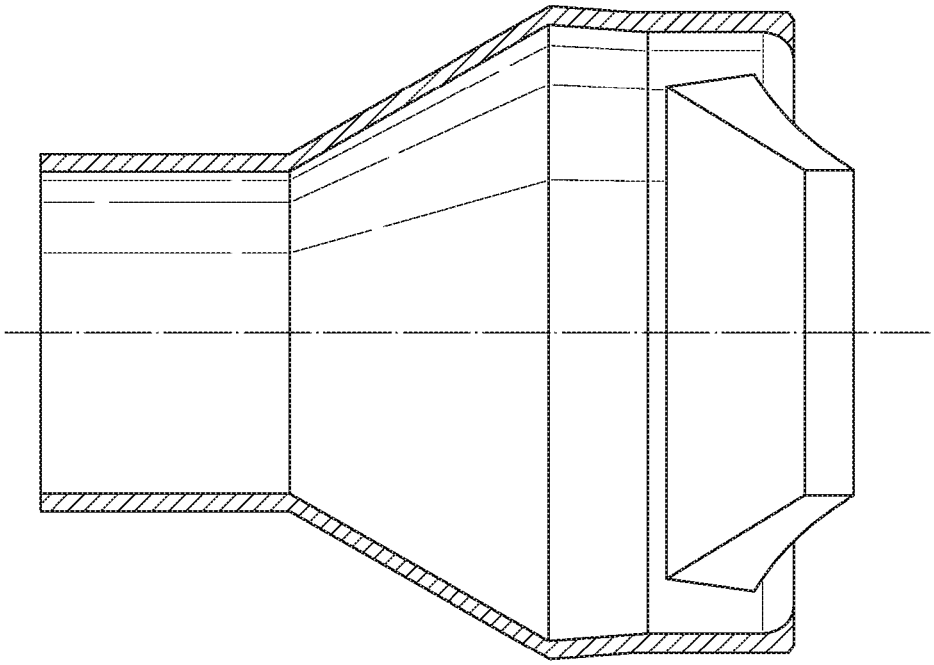
FIG. 20 is a sectional side view of the fourth example of a blast attenuation device of the present disclosure.
Figure 21:
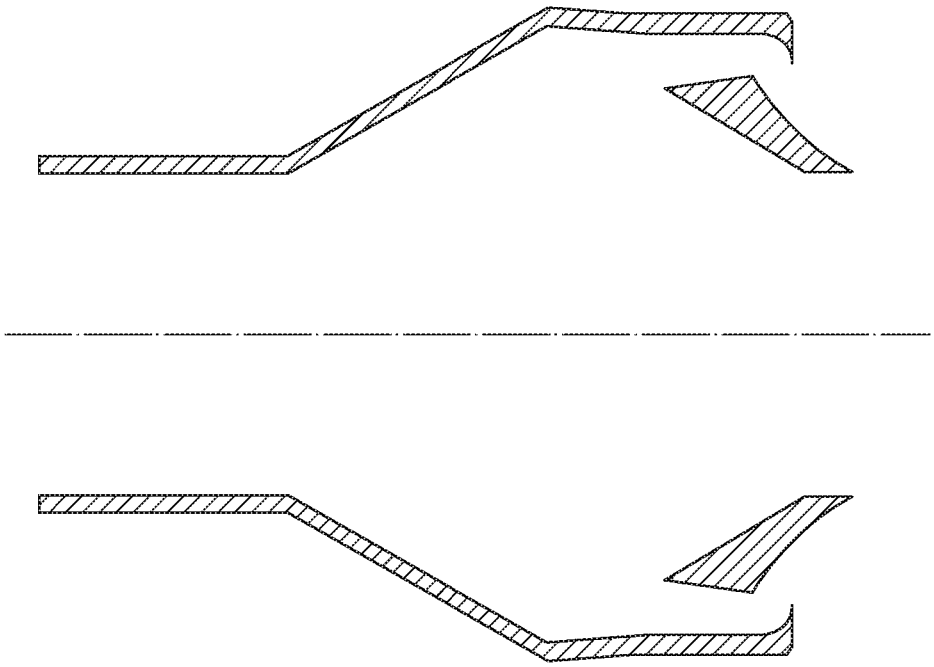
FIG. 21 is an alternative sectional side view to that shown in FIG. 20.

FIGS. 2 to 6 show different views and features of a first example of a blast attenuation device 100 of the present disclosure. FIGS. 7 to 9, 11 to 15 show different views and features of a second example of a blast attenuation device 1100 of the present disclosure. FIGS. 16, 18, 19 illustrate a variation of the second example. FIGS. 10, 17, 20, 21 illustrate a further variation of the second example. Features which are common to two or more examples are referred to with the same reference numeral.

In all cases, the blast attenuation device 100, 1100 has a longitudinal bore 140 which is centred on a longitudinal axis 20 of the blast attenuation device 100, 1100. Put another way, the longitudinal bore 140 extends through the blast attenuation device 100, 1100 and is centred on the longitudinal axis 20.

The blast attenuation device 100, 1100 may be integrally formed (i.e. provided as a mono structure), and it will be appreciated that the terms used to describe its features refer to different sections of this integrally formed structure. However they are described as separate features, even though they may be part of the same component, in order to distinguish the features of the geometry.

Common to all examples of the blast attenuation device 100, 1100 of the present disclosure are a first wall section 102, 1102 (which may be termed an outer cowl or outer sleeve) which defines a first chamber 104, 1104, which extends from an inlet end 106, 1106 having an inlet aperture 108, 1108 to an outlet end 110, 1100 having an outlet aperture 112, 1112. There is also provided a second wall section 122, 1122 (which may be termed an inner cowl or inner sleeve) which defines a second chamber 124, 1124, which extends from an inlet end 126, 1126 having an inlet aperture 128, 1128 to an outlet end 130, 1130 having an outlet aperture 132, 1132.

The first wall section 102, 1102 and second wall section 122, 1122 define a first region 144, 1144 of a bore 140, 1140 of the blast attenuation device 100, 1100, the first wall section 102, 1102 and the second wall section 122, 1122 being coaxial, concentric and/or centred on the longitudinal axis 20.

The second wall section 122, 1122 is spaced apart from the first wall section 102, 1102 to define a flow passage 142, 1142 between the first wall section 102, 1102 and second wall section 122, 1122. The first wall section 102, 1102 and second wall section 122, 1122 may both be circular in cross-section (i.e. cylindrical), and hence the flow passage 142, 1142 is annular.

Figure 5:
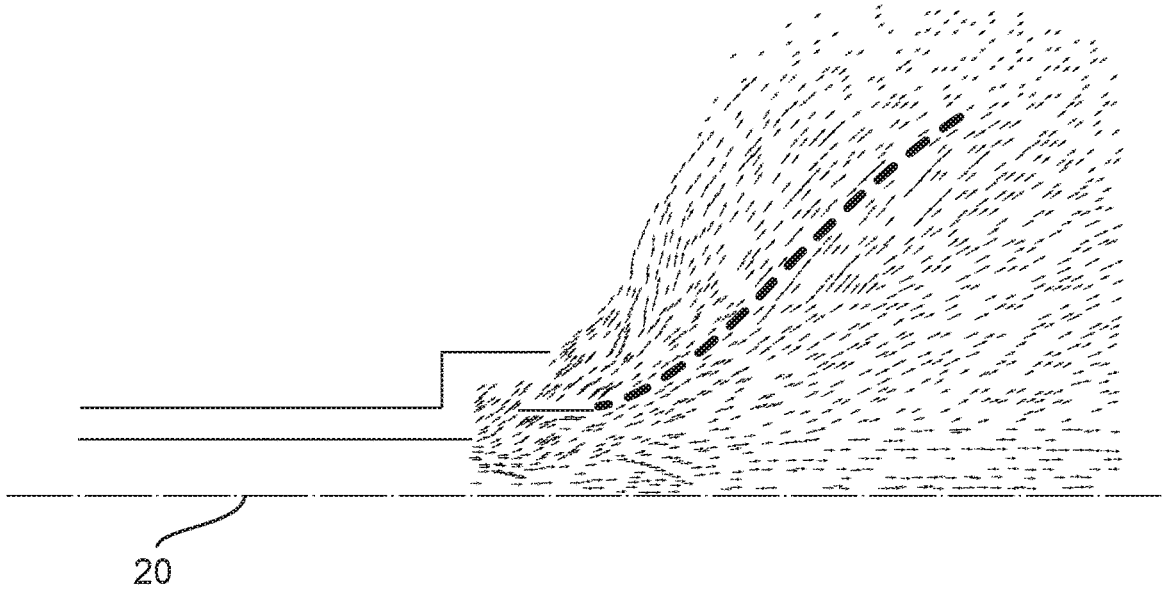
FIG. 5 is an alternative sectional side view to that shown in FIG. 4.
Figure 6:
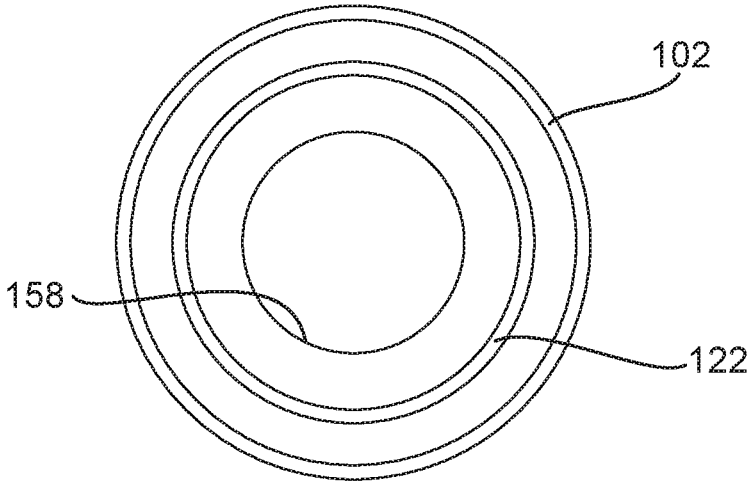
FIG. 6 is an end view of the first example of a blast attenuation device of the present disclosure, looking in a direction from the outlet to the inlet.
Figure 7:
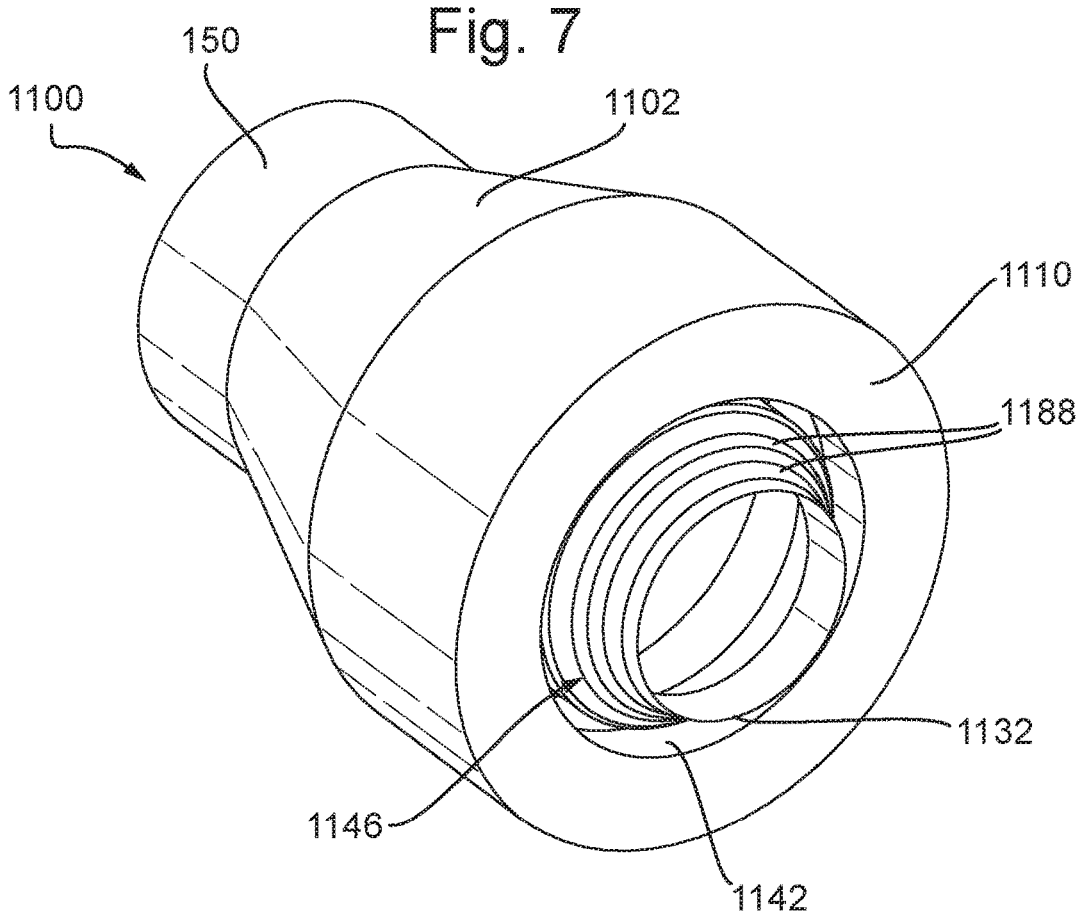
FIG. 7 is an isometric view of a second example of a blast attenuation device of the present disclosure.
Figure 8:
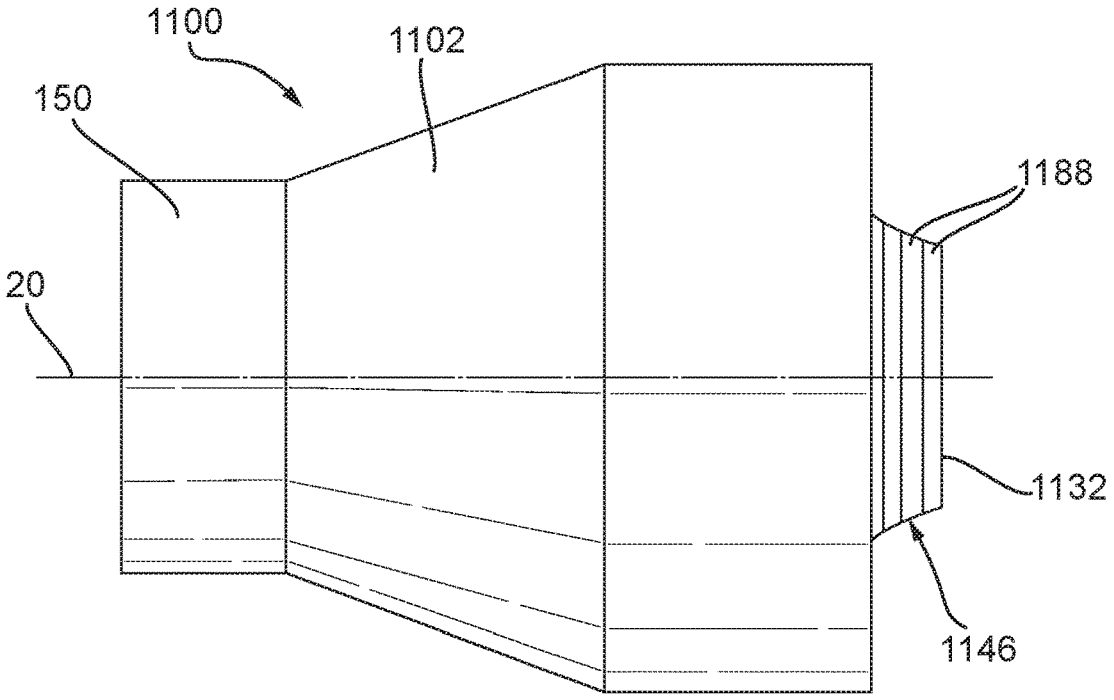
FIG. 8 is a side view of the second example of a blast attenuation device of the present disclosure.

A support member 148, 1148 (for example as shown in FIG. 5) extends between the first wall section 102, 1102 and second wall section 122, 1122 to fix the relative positions of the first wall section 102, 1102 and second wall section 122, 1122. For example, the support member 148, 1148 may be provided as a strut. There may be provided a number of struts spaced around the inner circumferential surface of the first wall section 102, 1102 and spaced around the outer circumferential surface of the second wall section 122, 1122, and spaced apart from one another to allow gas to flow therebetween.

The second wall section 122, 1122 is located in, and extends out of, the outlet aperture 112, 1112 of the first wall section 102, 1102, such that the first wall section 102, 1102 inlet aperture 108, 1108, second wall section 122, 1122 inlet aperture 128, 1128, first wall section 102, 1102 outlet aperture 112, 1112 and second wall section 122, 1122 outlet aperture 132, 1132 are provided in series along the longitudinal axis 20.

The blast attenuation device 100, 1100 may further comprise a support hub 150 which defines an inlet end 156 having an inlet aperture 158 to an outlet end 160 having an outlet aperture 162. The hub outlet end 160 extends to/from the inlet end 106 of the first wall section 102. The support hub 150 is coaxial with, concentric with and/or centred on the longitudinal axis 20. The support hub 150 defines a second region 146 of the bore 140 of the blast attenuation device 100, 1100.

The support hub 150, first wall section 102, 1102 and second wall section 122, 1122 define the longitudinal bore 140 which extends through the body of the blast attenuation device 100, 1100 and the support hub 150 between the support hub inlet end 156 and the outlet aperture 132, 1132 of the second wall section 122, 1122. The section of the bore 140 defined by the support hub 150 may have a constant diameter (for example, may be circular in cross-section) along the length of the support hub 150. However, the section of the bore 140 defined by the first wall section 102, 1102 and second wall section 122, 1122 differs in width/diameter and flow area along its length compared to the section of the bore 140 defined by the support hub 150, as will be described below, and as is evident from the figures.

The bore 140 of the support hub 150 may be substantially equal to the external diameter of the gun tube 10, for example so the gun tube 10 can fit into the support hub 150. Hence the calibre C (i.e. internal diameter of the bore of the gun tube 10) may be less than the diameter D of the bore 140 of the support hub 150.

In alternative examples, the diameter D of the bore 140 of the support hub 150 may be substantially equal to the calibre C (i.e. internal diameter of the gun tube 10), with the bore of the gun tube 10 being aligned with the bore 140 of the support hub 150.

As shown in the examples of FIGS. 2 to 6, the first wall section 102 may have a constant internal diameter along its length between its inlet end 106 and outlet end 110. Additionally the second wall section 122 may have a constant internal diameter along its length between its inlet end 126 and outlet end 130. The support hub 140, first wall section 102, 1102 and second wall section 122, 1122 may each have a circular cross-section.

As shown in the examples of FIGS. 7 to 21, the first wall section 1102 increases in internal diameter from the inlet aperture 1108 of the first chamber 1104 to a maximum diameter (Dmax) to define a divergent region 1170 of the first chamber 1104. The first wall section 1102 decreases in diameter from the maximum diameter Dmax to the outlet aperture 1112 to define a convergent region 1171 of the first chamber 1104. It should be noted that the convergent region 1171 is convergent in the sense that its exit diameter is smaller than its entry diameter, and the term may include examples in which the convergent region has sub-regions of constant diameter and/or which diverge (i.e. increase in diameter).

Figure 9:
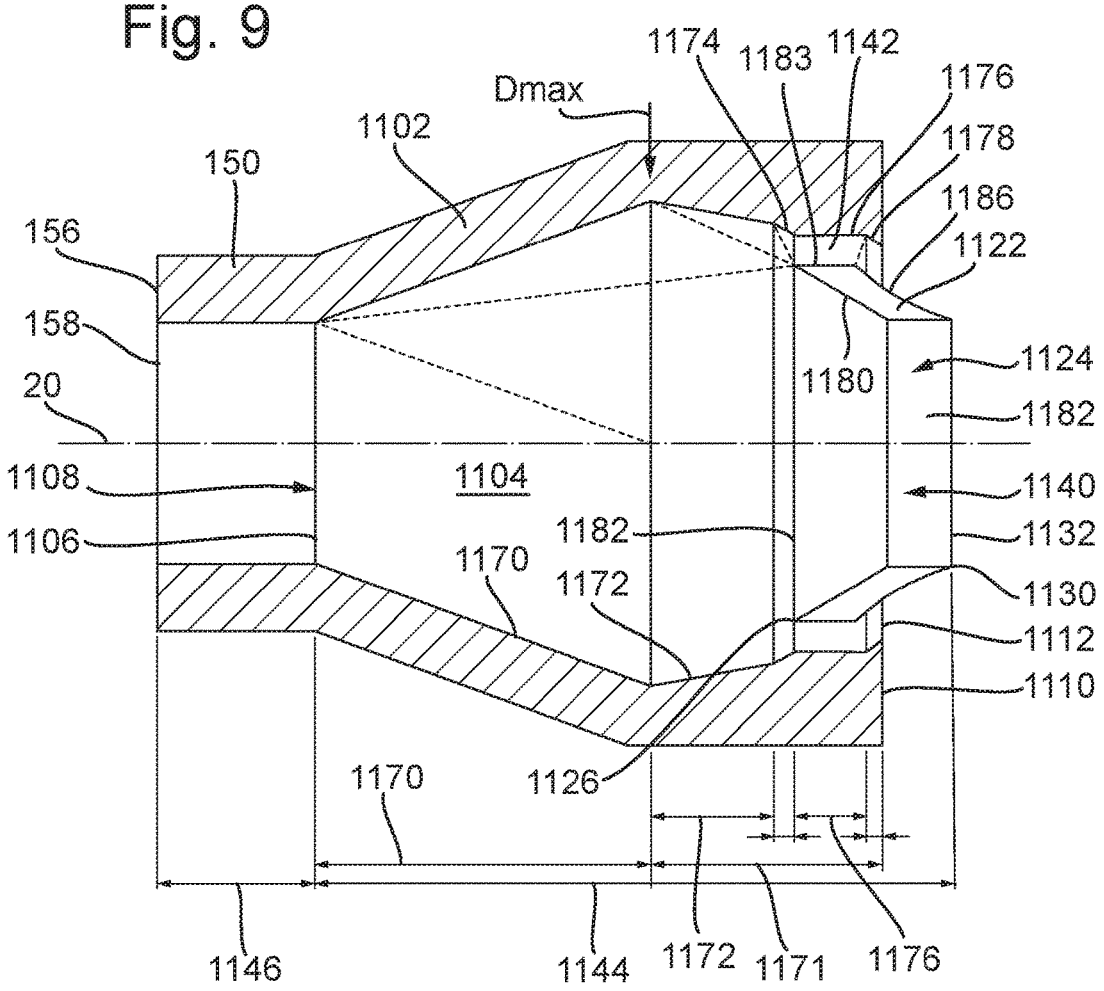
FIG. 9 is a sectional side view of the second example of a blast attenuation device of the present disclosure.

As shown in FIG. 9, the second wall section 1122 decreases in internal diameter from the inlet aperture 1128 of the second chamber 1124 to a minimum diameter Dmin to define a compression cone 1180, and then extends with a constant diameter of Dmin to the outlet aperture 1132 to define a flow passage 1182.

As shown in the examples of FIGS. 7 to 21, the convergent region 1171 of the first chamber 1104 is divided into sub-regions which extend in series from the maximum diameter Dmax to the outlet aperture 1112. In the examples shown, one of the sub-regions 1176 has a constant internal diameter along its length. In other examples, more than one of the sub-regions has a constant internal diameter along its length. The sub-region 1176 of constant internal diameter is spaced apart from the outlet aperture 1112 of the first wall section 1102 by a sub-region which decreases in diameter towards the outlet aperture 1112 of the first wall section 1102. The same sub-region 1176 (of constant internal diameter) is spaced apart from the diameter of maximum diameter Dmax of the first wall section 1102 by a sub-region which decreases in diameter towards the sub-region 1176 of constant internal diameter.

More specifically, in the examples of FIGS. 7 to 21, the convergent region 1171 of the first chamber 1104 comprises a first sub-region 1172, a second sub-region 1176 and a third sub-region 1178 provided in series, the first sub-region 1172 extending from the diameter of maximum diameter Dmax towards the second sub-region 1176, and the third sub-region 1178 extending from the second sub-region 1176 towards the outlet aperture 1112 of the first wall section 1102. The second sub-region 1176 has a constant internal diameter along its length, and is spaced apart from the outlet aperture 1112 of the first wall section 1102 by the third sub-region 1178 which decreases in diameter towards the outlet aperture 1112 of the first wall section 1102. That is to say the wall of third sub-region 1178 converges towards the outlet aperture 1112 of the first wall section 1102.

The second sub-region 1176 is spaced apart from the diameter of maximum diameter Dmax, and the divergent region 1170 of the first wall section 1102, by the first sub-region 1172 which decreases in diameter towards the second sub-region 1176. That is to say, the wall of the first sub-region 1172 converges towards the second sub-region 1176.

With reference to FIG. 9 the convergent region 1171 of the first chamber 1104 may further comprise a fourth sub-region 1174 which extends between the first sub-region 1172 and the second sub-region 1176. The fourth sub-region 1174 decreases in diameter from first sub-region 1172 to the second sub-region 1176. That is to say, the wall of the fourth sub-region 1174 converges from first sub-region 1172 to the second sub-region 1176.

Figure 14:
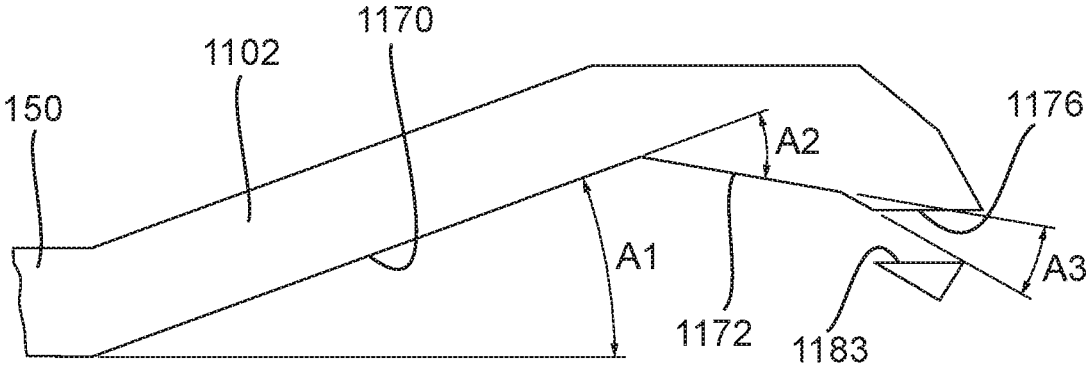
FIG. 14 is a first enlarged view of a section of the blast attenuation device shown in in FIG. 10.
Figure 15:
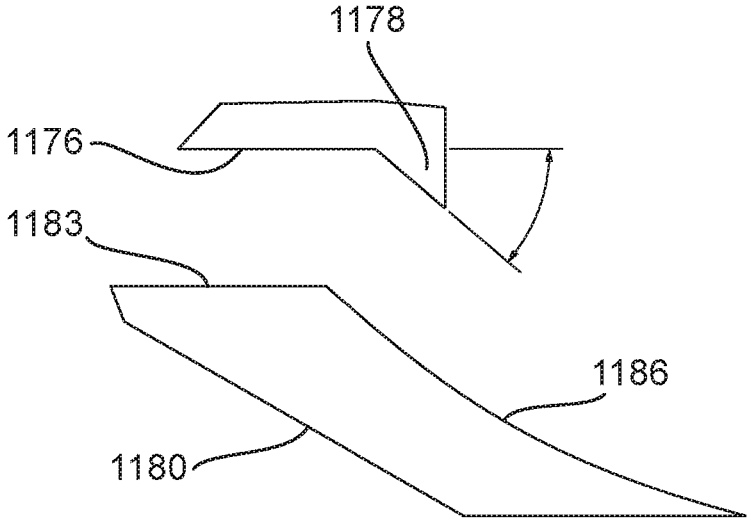
FIG. 15 is a second enlarged view of a section of the blast attenuation device shown in in FIG. 10.

As illustrated in FIGS. 14, 15, which show enlarged regions of the first wall section 1102 and second wall section 1222, the first wall section 1102 in the divergent region 1170 extends at an angle A1 of at least 5 degrees but not more than 60 degrees to the longitudinal axis 20.

Also as illustrated in FIGS. 14, 15, the first wall section 1102 in the first sub-region 1172 of the convergent region 1171 extends at an angle A2 of at least 10 degrees but not more than 65 degrees to the first wall section 1102 in the divergent region 1170. Depending on the mach number of the gas passing this feature, this change from a divergent region to a convergent region will compress and extract energy from the gas. This feature will cause gas to slow, and for its density, temperature and pressure to be raised.

Also as illustrated in FIGS. 14, 15, the first wall section 1102 in the fourth sub-region 1174 of the convergent region 1171 may extend at an angle A3 of no more than degrees to the first wall section 1102 in the first sub-region 1172. This will further slow the gas and further raise its density, temperature and pressure. In further examples there may be provided one or more such convergent steps.

As also illustrated in FIG. 14, 15, the first wall section 1102 in the third sub-region 1178 of the convergent region 1171 extends at an angle A4 of at least 15 degrees but no more than 90 degrees to first wall section 1102 in the second sub-region 1176. The first wall section 1102 in the third sub-region 1178 of the convergent region 1171 extends at an angle A4 of at least 15 degrees but no more than 90 degrees to the longitudinal axis 20.

This flow guide feature is configured to turn the gas towards the radially outer surfaces 1183, 1186 of the second wall section 1122. The radially outer surfaces 1183, 1186 of the second wall section 1122 act to direct the gas in a direction along the axis of, and away from, the weapon, reducing the tendency of gas expanding from a nozzle to expand in a random distribution of directions.

The second wall section 1122 defines a first radially outer surface 1183 which faces the second sub-region 1176 of the first wall section 1102. The second wall section 1122 further defines a second radially outer surface 1186 which extends from the first radially outer surface 1183 to the outlet end 1130 to define the outlet aperture 1132 of the second wall section 1122.

In the example of FIGS. 9, 11 to 15, the first radially outer surface 1183 of the second wall section 1122 is parallel to the second sub-region 1176 of the first wall section 1102 such that the flow passage 1142 therebetween has a constant flow area along its length.

In the example of FIGS. 10, 16 to 21, the first radially outer surface 1183 of the second wall section 1122 is angled to the second sub-region 1176 of the first wall section 1102 such that the flow passage 1142 therebetween converges towards the outlet aperture 1112 of the first wall section 1102. This may act to further slow and compress gas through this region, increasing potential mass flow. It may move gas to subsonic regimes.

In a direction along the longitudinal axis 20, the junction between the first radially outer surface 1183 of the second wall section 1122 and the second radially outer surface 1186 of the second wall section 1122 may be within the second sub-region 1176, and spaced apart from the third sub-region 1178. This acts to direct and control the gas flow at the "throat" formed by the flow passage 1142. The gas at this point should be at its most compressed, prior to passing along and past the second radially outer surface 1186 of the second wall section 1122. From here the gas is directed as it expands in a direction along the gun axis 20.

Figure 12:
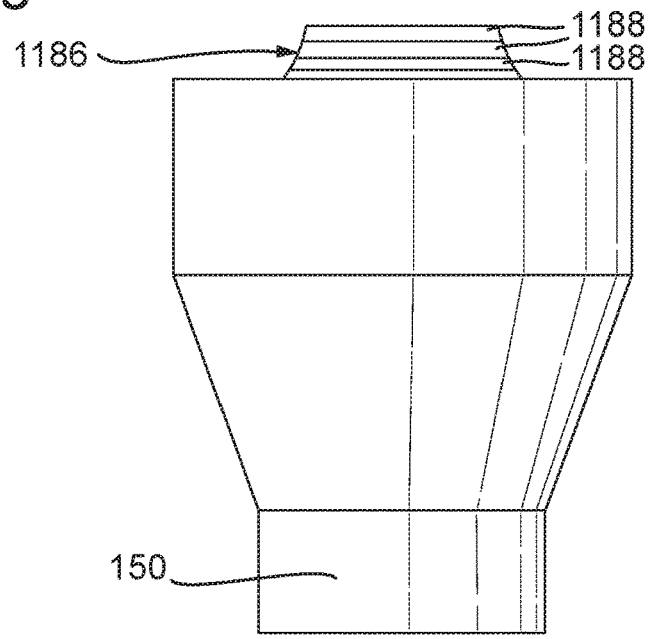
FIG. 12 is a side view of the second example of a blast attenuation device of the present disclosure shown in FIG. 7.
Figure 13:
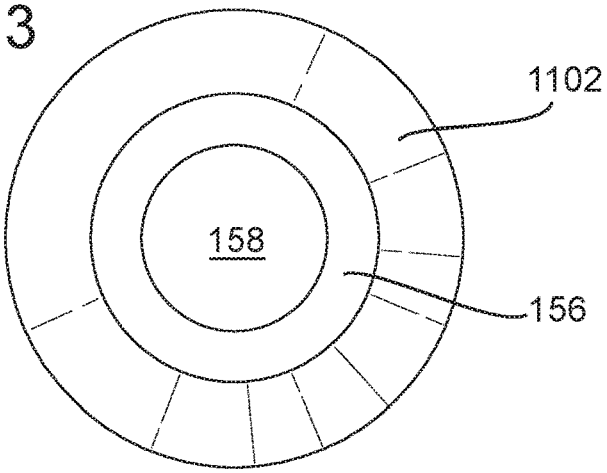
FIG. 13 is a second end view of the second example of a blast attenuation device of the present disclosure, looking in a direction from the inlet to the outlet.

The second radially outer surface 1186 is concave. That is to say, the second radially outer surface is angled to the longitudinal axis 20, the distance from the longitudinal axis 20 reducing as distance from the support hub 150 increases. The second radially outer surface 1186 may have a smooth (i.e. continuous) surface. Alternatively, the surface may comprise a series of stepped rings (or tiers) 1188 for example as shown in FIGS. 12, 16, 17. The radially outer surface of the stepped rings 1188 maybe parallel to the longitudinal axis 20. Alternatively, the radially outer surface of the stepped rings 1188 may be at an angle to the longitudinal axis 20, converging towards the longitudinal axis 20 as the distance from the support hub 150 is increased.

The second radially outer surface 1186 may be angled to longitudinal axis 20 by the same amount as the third sub-region 1178 is angled to longitudinal axis 20.

The flow area of the flow passage 142, 1142 is greater than the flow area of the outlet aperture 132, 1132 of the second wall section 122, 1122. This ensures the mass flow rate through the outer passage 142, 1142 will have a higher mass flow rate than that of the inner passage 132, 1132, which should act to direct the inner flow in a direction along the axis 20 of the weapon.

The surface of the compression cone 1180 will affect flow of the central gas flow region as the angle of its walls will act to slow and compress the flow across the entire bore. The angle of the radially inner surface of the second wall section 1120 (i.e. the compression cone) to the longitudinal axis may be at least 5 degrees but no more than 90 degrees.

The variant of FIGS. 16, 18, 19 and the variant of FIGS. 10, 17, 20, 21 are essentially the same as that of FIGS. 7 to 9, 11 to 15. As described above, they illustrate that first radially outer surface 1183 of the second wall section 1122 is angled to the second sub-region 1176 of the first wall section 1102. Additionally they illustrate that the second wall section 1122 may be provided/sized to extend out of the first wall section 1102 outlet aperture 1112 to varying degrees. Further these examples show embodiments in which the convergent region 1171 comprises only a first sub-region 1172, a second sub-region 1176 and a third sub-region 1178 provided in series, rather than also including a fourth sub-region 1174 as set out with respect to the example of FIG. 9. These examples also demonstrate the flexibility of design that may be achieved by varying the extent of the radially outer surfaces 1183, 1186 of the second wall section 1122, which can be varied to balance length against performance.

In operation, the blast attenuation devices of the present disclosure are operable to direct forward sound generated by the firing of a projectile from the weapon. That is to say, unlike some blast attenuation devices, it is not configured to reduce the absolute energy of the sound generated, but to direct it forwards (i.e. in the direction of travel of the projectile) away from the user of the weapon.

Figure 10:
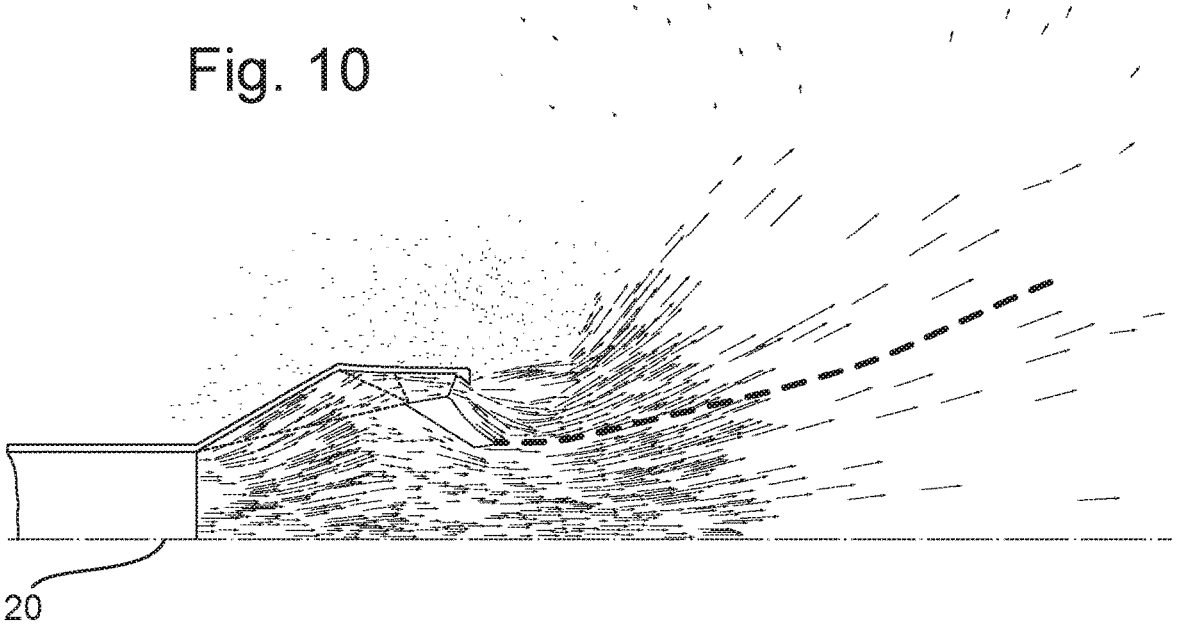
FIG. 10 is a sectional view of a blast attenuation device as shown in FIGS. 20, 21.
Figure 11:
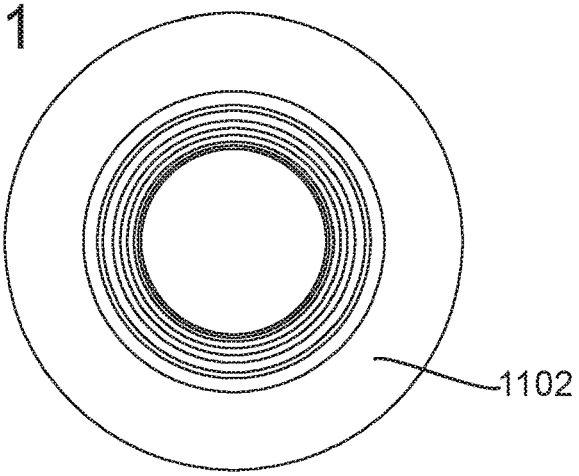
FIG. 11 is a first end view of the second example of a blast attenuation device of the present disclosure, looking in a direction from the outlet to the inlet.

In operation, for example when a projectile is fired from the gun tube 10, the projectile will enter the blast attenuation device at the hub inlet end 156 (i.e. the inlet aperture 158) pass through and exit the blast attenuation device 100, 1100 through the second wall section outlet aperture 132, 1132. After the projectile has left the blast attenuation device 100, 1100 gas will flow into the first chamber 104, 1104 and the geometry of the blast attenuation device is such that, exiting the blast attenuation device is an outer flow region which forms a lower pressure jet plume which acts like a virtual bell nozzle containing a central flow region main gas flow, and thus defines where gas travels when exiting the blast attenuation device, and thus the pressure waves generated by the firing of the weapon. The outer flow region may also/alternatively be termed an outer gas flow region. The central flow region may also/alternatively be termed a central gas flow region. The gas flow regions are illustrated in FIGS. 5, 10, with a curved dashed line indicating a boundary region between the outer flow region and the central flow region. That is to say, gas flow through the flow passage 142, 1142 forms the outer gas flow region, gas flow through the second wall section outlet aperture 132, 1132 forms the central gas flow region, such that gas exiting the annular flow passage 142, 1142 at the outlet aperture 112, 1112 of the first wall section 102, 1102 forms the outer gas flow region which bounds the gas exiting the outlet aperture 132, 1132 of the second wall section 122, 1102 which forms the central gas flow region. Put another way, the outer flow region radially outward of the dashed curved boundary line creates a sheathing flow which contains the higher pressure gas in the central flow region biasing the gas of the central flow region forwards and thus reducing the amount of gas which can travel rearward to the crew/operator of the weapon after the propellant gases have exited the blast attenuation device 100, 1100. The gas in the outer flow region is at a lower pressure than that in the central flow region as a result of the flow path defined by the due to geometry, and thus flow path characteristics, of the blast attenuation device 100, 1100

In all examples of the blast attenuation device of the present disclosure, the first wall section 102, 1102 (which may be termed an outer cowl) and second wall section 122, 1122 (which may be termed an inner sleeve) of the examples of the present disclosure are operable to create the outer flow region and the central flow region.

In the first example of the blast attenuation device, as shown in FIGS. 2 to 6, there is an initial expansion phase in the outer flow region which results in the creation of the outer flow region and central flow region of gas flow as the gas flows exit the blast attenuation device.

The lower pressure gas of the outer flow region flows out of the flow passage 142 sheathing the inner plume of the central flow region as it exits the outlet aperture 132 containing it and pushing it forward. In turn, this reduces the size of shock wave travelling backwards along the barrel/tube 10 to the operators, and thus reduces Blast Over Pressure (BOP).

The plume generated by outer flow region also creates a region of reduced temperature and increased velocity (caused by gas expansion) around the exit from the blast attenuation device. This also acts to push the large gas plume exiting the blast attenuation device forwards, away from the weapon, reducing shocks being emitted back down the barrel.

The second example of the present disclosure as shown in FIGS. 7 to 9, 11 to 15, and its variants shown in FIGS. 10, 16 to 21, may produce the same effect as the first example, although because of their geometry, they operate in a different way to produce shock waves to vary the speed and pressure of the gas as it moves through the blast attenuation device.

With reference to FIGS. 9, 10, gas exiting the gun muzzle enters the divergent region 1170 of the first chamber 1104 and is expanded by the formation of a cone angled using the Mach angle of the gas flow. Dotted straight lines in FIG. 10 indicate rough positions of oblique shocks defining a supersonic expansion fan. As is understood in the art, a supersonic expansion fan is an expansion process that occurs when a supersonic flow turns around a convex corner. Hence the shocks are triggered because of the interaction of gas flow over the inflexions on the surface of the first wall section 1102 and second wall section 1122. This expansion phase across shock waves is used to split the gas into an outer flow region and a central flow region. The central flow region is directed into the compression cone 1180 of the blast attenuation device. The outer flow region surrounds the central flow region and spaces it apart from the surface of the first wall section 1102. The outer flow region is directed along the inner surface of the first wall section 1102 to the flow passage 1142 between the first wall section 1102 and second wall section 1122.

In the convergent region 1171 the expanded gas of the outer flow region is compressed using a series of oblique shock waves which have been initiated/induced by the geometry of the blast attenuation device. Dotted straight lines indicate oblique shocks that form boundaries of differing flow regions within the expansion region and compression region.

Gas in the outer flow region is slowed and compressed as it crosses a shock wave on the approach to and through the flow passage 1142, while gas of the central flow region is accelerated and expanded along the surface of the compression cone 1180 defined by the second wall section 1122. The initial expansion pushes the majority of the gas along through the second wall section outlet aperture 1132 in a direction parallel to the longitudinal axis 20 (i.e. rather than allowing it to flow out omnidirectionally. This effect is believed to ultimately restrict the blast over pressure behind the muzzle.

The gas of the outer flow region is turned and directed along the second radially outer surface 1186 of the second wall section 1122, which controls its expansion and forms a lower pressure jet plume on exit from the outlet aperture 1112 (i.e. on exit from the flow passage 1142). The lower pressure jet plume of the outer region is used to control and push forward the expansion of the central flow region. This prevents gas from moving backwards along the barrels outer structure and forming a large blast over pressure.

The apparatus of the present disclosure is operable to reduce blast overpressure generated by the firing of a gun compared to blast attenuation devices of the related art. The blast attenuation device of the present application is applicable to a large or small calibre weapon. This reduces injurious effects and fatigue to the user of operating such a weapon. With large calibre weapons in particular, using a crew to operate, this will improve the options for training with the platform along with reducing the long term hearing damage to which gun crews can be susceptible.

The blast attenuation device of the present disclosure is operable to reduce the blast overpressure of weapons below that of a bare barrel by between 30% and 65% with low to negligible increase in recoil energy.

The configuration of the blast attenuation device of the present disclosure is advantageous since is may be provided with a size and weight which enables it to be deployed across a range of calibres.

Additionally its design requires very little maintenance compared to examples of the related art.

The first example of the present disclosure (shown in FIGS. 2 to 6) is operable to generate up to a 32% reduction in blast overpressure compared to a bare barrel and up to 78% reduction compared to current state of the art muzzle brake.

The second example of the present disclosure as shown in FIGS. 7 to 9, 11 to 15, and its variants shown in FIGS. 10, 16 to 21, utilises principles in line with a SCRAMJET engine, and is configured to deliver up to 65% reduction in blast overpressure compared to a bare barrel and approximately 88% reduction on current state of the art muzzle brake.

The examples of the present disclosure also have a simpler design than many examples of the related art, and hence are easier to produce and maintain, and are generally lighter.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A blast attenuation device for a gun tube, the blast attenuation device having a longitudinal axis and comprising:

a first wall section which defines a first chamber, which extends from an inlet end having an inlet aperture to an outlet end having an outlet aperture;

a second wall section which defines a second chamber, which extends from an inlet end having an inlet aperture to an outlet end having an outlet aperture;

the second wall section being spaced apart from the first wall section to define a flow passage between the first wall section and second wall section;

such that gas flow through the flow passage forms an outer gas flow region, gas flow through the second wall section outlet aperture forms a central gas flow region, and the outer gas flow region bounds the central gas flow region, wherein the first chamber decreases in diameter along a flow path to the outlet aperture of the first chamber and wherein the second wall section extends with a constant diameter from the outlet aperture of the first chamber to the outlet aperture of the second chamber.

2. The blast attenuation device of claim 1, wherein the first wall section and second wall section define a first region of a bore of the blast attenuation device, the first wall section and the second wall section being coaxial with the longitudinal axis.

3. The blast attenuation device of claim 2, further comprising:

a support hub which defines an inlet end having an inlet aperture to an outlet end having an outlet aperture, wherein the hub outlet end extends to/from the inlet end of the first wall section;

the support hub being coaxial with the longitudinal axis; and the support hub defines a second region of the bore of the blast attenuation device.

4. The blast attenuation device of claim 1, wherein the second wall section is located in the outlet aperture of the first wall section, such that the first wall section inlet aperture, second wall section inlet aperture, first wall section outlet aperture, and second wall section outlet aperture are provided in series along the longitudinal axis.

5. The blast attenuation device of claim 1, wherein the first wall section:

increases in internal diameter from the inlet aperture of the first chamber to a maximum diameter to define a divergent region of the first chamber; and decreases in diameter from the maximum diameter to the outlet aperture to define a convergent region of the first chamber.

6. The blast attenuation device of claim 5, wherein the second wall section:

decreases in internal diameter from the inlet aperture of the second chamber to a minimum diameter (Dmin) to define a compression cone.

7. The blast attenuation device of claim 5, wherein:

the convergent region of the first chamber is divided into sub-regions which extend in series from the maximum diameter to the outlet aperture (1112);

at least one of the sub-regions has a constant internal diameter along its length;

the at least one of the sub-regions is spaced apart from the outlet aperture of the first wall section by a sub-region which decreases in diameter towards the outlet aperture of the first wall section; and the at least one of the sub-regions is spaced apart from the diameter of maximum diameter of the first wall section by a sub-region which decreases in diameter towards the sub-region of constant internal diameter.

8. The blast attenuation device of claim 5, wherein the convergent region of the first chamber comprises a first sub-region, a second sub-region, and a third sub-region provided in series, the first sub-region extending from the diameter of maximum diameter towards the second sub-region, and the third sub-region extending from the second sub-region towards the outlet aperture of the first wall section, wherein:

the second sub-region has a constant internal diameter along its length, and is spaced apart from the outlet aperture of the first wall section by the third sub-region which decreases in diameter towards the outlet aperture of the first wall section; and the second sub-region is spaced apart from the divergent region of the first wall section by the first sub-region which decreases in diameter towards the second sub-region.

9. The blast attenuation device of claim 8, wherein the convergent region of the first chamber further comprises a fourth sub-region which extends between the first sub-region and the second sub-region, and wherein the fourth sub-region decreases in diameter from first sub-region to the second sub-region.

10. The blast attenuation device of claim 9, wherein the first wall section in the divergent region extends at an angle A1 of at least 5 degrees but no more than 60 degrees to the longitudinal axis, and wherein the first wall section in the fourth sub-region of the convergent region extends at an angle A3 of no more than 30 degrees to the first wall section in the first sub-region.

11. The blast attenuation device of claim 8, wherein the second wall section defines: a first radially outer surface which faces the second sub-region of the first wall section; and a second radially outer surface which extends from the first radially outer surface to the outlet end to define the outlet aperture of the second wall section.

12. The blast attenuation device of claim 11, wherein the first radially outer surface of the second wall section is parallel to the second sub-region of the first wall section such that the flow passage therebetween has a constant flow area.

13. The blast attenuation device of claim 11, wherein the first radially outer surface of the second wall section is angled to the second sub-region of the first wall section such that the flow passage therebetween converges towards the outlet aperture of the first wall section.

14. The blast attenuation device of claim 11, wherein, in a direction along the longitudinal axis, the junction between the first radially outer surface of the second wall section and the second radially outer surface of the second wall section is within the second sub-region, and spaced apart from the third sub-region.

15. The blast attenuation device of claim 11, wherein the second radially outer surface is angled to the longitudinal axis by the same amount as the third sub-region is angled to longitudinal axis.

16. The blast attenuation device of claim 8, wherein the first wall section in the divergent region extends at an angle A1 of at least 5 degrees but no more than 60 degrees to the longitudinal axis, and wherein the first wall section in the first sub-region of the convergent region extends at an angle A2 of at least 10 degrees but no more than 65 degrees to the first wall section in the divergent region.

17. The blast attenuation device of claim 8, wherein the first wall section in the divergent region extends at an angle A1 of at least 5 degrees but no more than 60 degrees to the longitudinal axis, wherein the first wall section in the third sub-region of the convergent region extends at an angle A4 of at least 15 degrees but no more than 90 degrees to the first wall section in the second sub-region.

18. The blast attenuation device of claim 5, wherein the first wall section in the divergent region extends at an angle A1 of at least 5 degrees but no more than 60 degrees to the longitudinal axis.

19. A blast attenuation device for a gun tube, the device comprising:

a first wall section which defines a first chamber, which extends from an inlet end having an inlet aperture to an outlet end having an outlet aperture; and a second wall section which defines a second chamber, which extends from an inlet end having an inlet aperture to an outlet end having an outlet aperture, the second wall section being spaced apart from the first wall section to define a flow passage between the first wall section and second wall section, the second wall section being located in the outlet aperture of the first wall section, such that the first wall section inlet aperture, second wall section inlet aperture, first wall section outlet aperture, and second wall section outlet aperture are provided in series along a longitudinal axis;

wherein the first chamber decreases in diameter along a flow path to the outlet aperture of the first chamber and wherein the second wall section extends with a constant diameter from the outlet aperture of the first chamber to the outlet aperture of the second chamber; and wherein in operation, gas flow through the flow passage forms an outer gas flow region, and gas flow through the second wall section outlet aperture forms a central gas flow region, and gas in the outer flow region is at a lower pressure than gas in the central gas flow region.

* * * * *